United States Patent [19]

Milles

[11] 4,267,716

[45] May 19, 1981

[54] COMBINATION LOCK FOR BAGGAGE

[75] Inventor: Peter Milles, Alberthofen, Fed. Rep. of Germany

[73] Assignee: S. Franzen Sohne (GmbH & Co.), Fed. Rep. of Germany

[21] Appl. No.: 55,067

[22] Filed: Jul. 5, 1979

[30] Foreign Application Priority Data

Jul. 7, 1978 [DE] Fed. Rep. of Germany ..... 2828859
Jul. 8, 1978 [DE] Fed. Rep. of Germany ..... 2830091
Jul. 8, 1978 [DE] Fed. Rep. of Germany ..... 2830092

[51] Int. Cl.[3] ..... E05B 37/02; E05B 65/52
[52] U.S. Cl. ..... 70/70; 70/312
[58] Field of Search ..... 70/2, 3, 5, 67–76, 70/312, 323, 327, 328, 320, 321, 322

[56] References Cited

U.S. PATENT DOCUMENTS 2,136,493 11/1938 Denerich ..... 70/323
3,416,338 12/1968 Gehrie ..... 70/312

*Primary Examiner*—Robert L. Wolfe
*Attorney, Agent, or Firm*—Gottlieb, Rackman & Reisman

[57] ABSTRACT

A combination lock for baggage has blocking sleeves rotatable on a spindle with and by respective number selection discs into an opening configuration in which a locking bolt can be withdrawn. The number selection discs are retained in selected angular positions by means of spring tongues which engage in catch recesses and which are formed integrally with a box-like insert in the lock housing.

6 Claims, 7 Drawing Figures

26''
26
8
36'
13
13'
12'
35'
11
ST
40
45
12
B
39
8'
14
F
V
V
44
43
46
17
4
28
24
27
21'
21
33
34
1
17
8
16
36
32
32'
13
12

COMBINATION LOCK FOR BAGGAGE

The invention relates to a combination lock for baggage, such as cases and bags, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions. Such a lock is hereinafter referred to as of the kind described.

A combination lock of this kind is known, for example, from West German Patent Specification No. 1,678,066. The limiting of the rotation of the number selection discs in the datum positions enables so called blind setting. One catch recess in the periphery of each disc has, for that purpose, a steep flank. This catch recess exhibiting the steep flank lies at a point on the circumference of the disc such that, when engaged by the corresponding spring tongue, the tongue locates the disc in an angular position in which a datum symbol such, for example, as zero, is displayed. From this datum setting of all the discs the user can perform a resetting of the opening combination without having to inspect the numbers, by simply counting up the succession of clicks, starting from the datum position.

The spring tongues project from a frame like spring component and are produced by cutting the component. Starting from one arm of the frame they extend freely into the lock housing which allows sufficient room for deflection. In addition to that the spring tongues are bent slightly out of the plane of the frame and are arched or bent down respectively in such a way that their front edges in the datum position come up against the steep flank. For the achievement of a certain surface stability rung-like material bridges are left between longer arms of the frame. This spring part is actually relatively expensive; in addition to which, in the case of a righthand or lefthand lock two different spring parts are necessary. This demands identification of components which appear at first glance completely the same, and raises the cost of manufacture and demands particular attention in the assembly of the locks. The structural difference is necessary in order to obtain locking in the same direction in spite of righthand or lefthand use.

Another disadvantage in constructions of this kind is that for actuation of a secret resetting device the spindle carrying the row of blocking sleeves must, for displacing the blocking sleeves, be displaced in the lock housing by the travel needed for setting the numbers. For doing this a shoulder is associated with the spindle or upset on it. An end one of the blocking sleeves bears against this shoulder. The other side of the shoulder rests against a crosswall which can be displaced along with it and through which the spindle passes and which carries an actuator at the end. The actuator incorporates a bush having a sliding lever passing through a slot in the bottom of the housing. The slot exhibits a transverse step against which the sliding lever bears to hold the blocking sleeves disengaged from their respective number selection discs which themselves cannot be displaced axially. In this position resetting can be effected. The end of the spindle opposite from the locking end is supported in a second crosswall independent of the housing, which forms the abutment for the spring loading of the blocking sleeves. The spindle which can be displaced axially needs a free space in the housing corresponding with its travel. In order to reduce this as much as possible, that is to provide a compact construction of the lock casing, the crosswall at the hasp of the lock housing is pierced for the spindle to pass through. This construction is above all costly to manufacture.

It is regarded as a disadvantage that the spindle needs a shoulder formed or upset on it. It is not possible to use a smooth rod for forming the spindle. Disadvantageous too for manufacture and assembly is the plurality of parts to be inserted. Furthermore, the merely springy bearing of the sliding lever of the secret resetting device is in practice completely inadequate. Thus it can occur that through a blow or a thrust from the contents of the baggage the sliding lever moves into the other end position which makes possible resetting. By random twisting of the number selection discs an unintentional resetting may happen, which makes the lock practically valueless. It has therefore already been proposed to block the projecting end section of the sliding lever with a plate consisting, for example, of fibrous material, which in order to do so bears against a projection from the bottom of the housing. But this measure too is not successful inasmuch as this safety plate easily comes loose.

The object of the invention is to construct a combination lock of the kind described which is simple to produce and assemble, and in accordance with the invention this is achieved in that the spring tongues are formed integrally with a box-like insert in the lock housing.

Preferably, the lock housing insert is formed symmetrically on each side of its transverse central plane, both end walls of the insert having similar bearings for receiving the ends of the spindle with a snap action and both regions of a bottom of the insert adjacent to the end walls having openings for the optional passage of a hand actuator for the displacement of the blocking sleeves relatively to the number selection discs. The same component exhibiting the spring tongues can then be used without structural alteration for both righthand and lefthand closing locks and, besides the catch spring function provides further functions which simplify assembly, and safe use of the lock. Stock holding and assembly are thereby simplified, especially with regard to mechanical assembly when the lock housing insert is symmetrical on each side of its transverse central plane, its use does not depend upon any preorientation, since both end walls of the insert are designed exactly the same as regards reception of the spindle and the means receiving the hand actuator for displacement of the blocking sleeves. The box-like insert simply needs to be turned round only by 180° so that the spring tongues lie on the other side of the longitudinal central plane of the lock housing. By insertion of number selection discs made correspondingly symmetrically, the blocking at the datum positions then occurs in the required sense direction.

The box-like insert which in view of the required springiness of its tongues is formed of elastic material, such as a plastics material, may provide, apart from the formation of the spring tongues, yet another function, namely, the formation of snap-in mountings for the spindle. This too facilitates assembly in that the lock housing insert together with its inserted parts can be preassembled as a righthand or lefthand lock unit and this unit then merely needs to be inserted in the lock housing. This can likewise be effected conveniently and without the use of tools by making use of the springiness of the insert and forming appropriate catch projections. The spindle, carrying the blocking sleeves and number selection discs, when snapped in, may secure in addition the blocking sleeve displacement hand actuator of a secret resetting device, which may be simply arranged in an opening in the bottom of the insert. The openings also have the effect of saving material. The lock housing insert may furthermore be the carrier for a spring or springs which load the sliding locking bolt and blocking sleeves. For the purpose regions of the bottom of the insert adjacent to its end walls may be provided with appropriate mountings. The spindle, extending at a distance above these mountings, can consequently be used also for securing in position the inserted spring.

Advantageously, the spring tongues are formed from webs or other strips provided in the bottom region of the lock housing insert. Such free-running webs, when extending from wall to wall of the insert, increase the flexibility of the molded spring tongues by making use of the restoring force of the material of the insert. Taking into consideration the large diameter of the number selection discs the webs may be forced out further in the direction of the bottom of the lock housing. This and the possible provision of funnel-shaped beveled flanks at the bottom of the insert alongside these strips facilitates the positioning of the discs in a row on the spindle. The discs adjust themselves, upon assembly, into the correct position by sliding down the beveled flanks.

Spring claws may be are moulded or otherwise formed on regions of the bottom of the insert adjacent to the end walls for location of the hand actuator for displacement of the blocking sleeves, in both of its end positions. Likewise again by making use of the restoring force of the material of the insert two snap-in end positions are achieved here for the displacement actuator. The spindle does not have to be displaced for resetting of the combination. The previously required structural considerations such as free spaces for deflection and driving shoulders, are of less importance in the new lock.

The spindle may be made in practice from commercially available rod material which may be simply cut to length. Special crosswalls may be omitted.

The hand actuator for displacement of the blocking sleeves may advantageously act directly in the release direction upon an end one of the blocking sleeves. The frictional forces are low, resulting in easy running in a way favorable to operation. The hand actuator for displacement of the blocking sleeves is advantageously designed as a rotatably supported fingerpiece having a cam which acts upon the end blocking sleeves. Random shock and thrust loadings on the shank of the cam are unlikely to turn it, especially if the cam exhibits at least two contact faces for the end blocking sleeve, which correspond with two end positions of the fingerpiece and lie at an angle to one another. Since the blocking sleeves are under permanent spring loading it needs an absolutely deliberate turning motion in order to operate the actuator and displace the blocking sleeves for resetting the combination. The blocking sleeve spring thereby fulfills a further function. A coin may be used for displacing the blocking sleeves if the end of the shank forming the fingerpiece has a cross-slit to receive the coin. The shank may lie in a position intersecting an inclined section of the lock housing, whereby an additional support may be provided for the hand actuator, extending an appreciable way out along at least one side of the actuator. This inclined section may arise from the formation in the bottom of the lock housing of a dished depression to accommodate the number selection discs which have a larger cross-section than other inserted parts.

For securing the connection to the lock housing catch projections may be molded or otherwise formed on the lock housing insert, and arranged to snap into corresponding openings in the lock housing. The insert thus provides a further function.

Some examples of combination locks constructed in accordance with the invention are illustrated in the accompanying drawings, in which.

Figure 1:
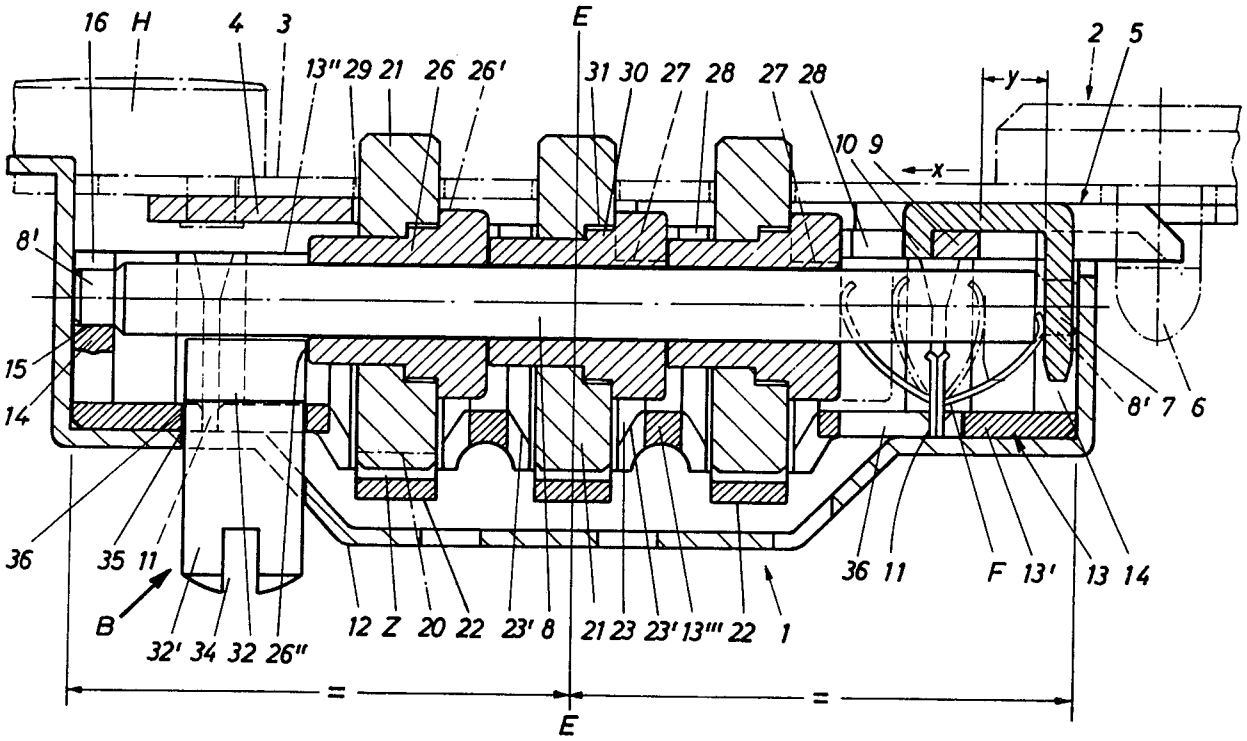
FIG. 1 is a longitudinal section through one lock, assembled as a lefthand lock, on an enlarged scale.
Figures 3, 4, 5:
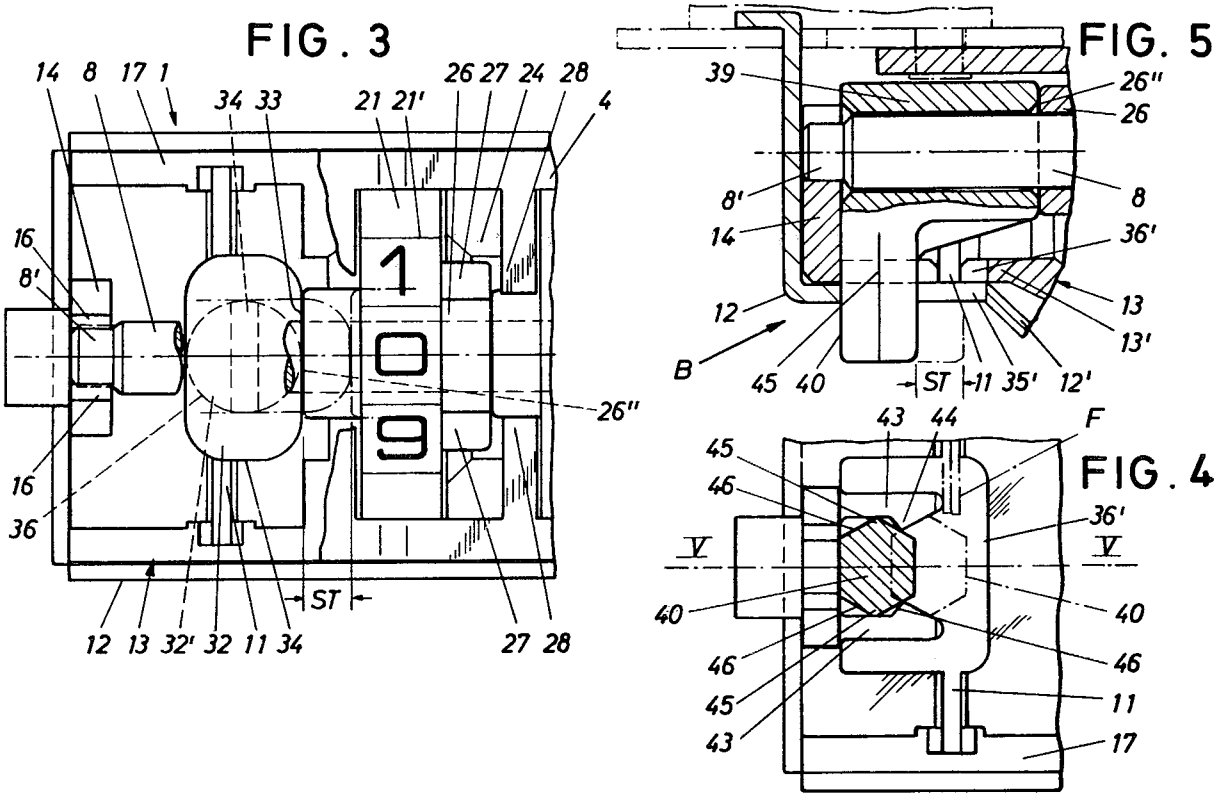
FIG. 3 is a partial plan of the lock, illustrating a hand actuator for displacement of the blocking sleeves.
Figure 7:
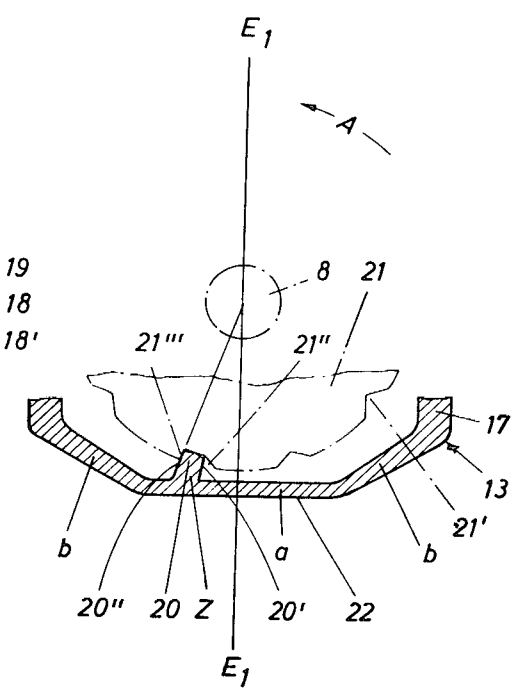
Figure 6:
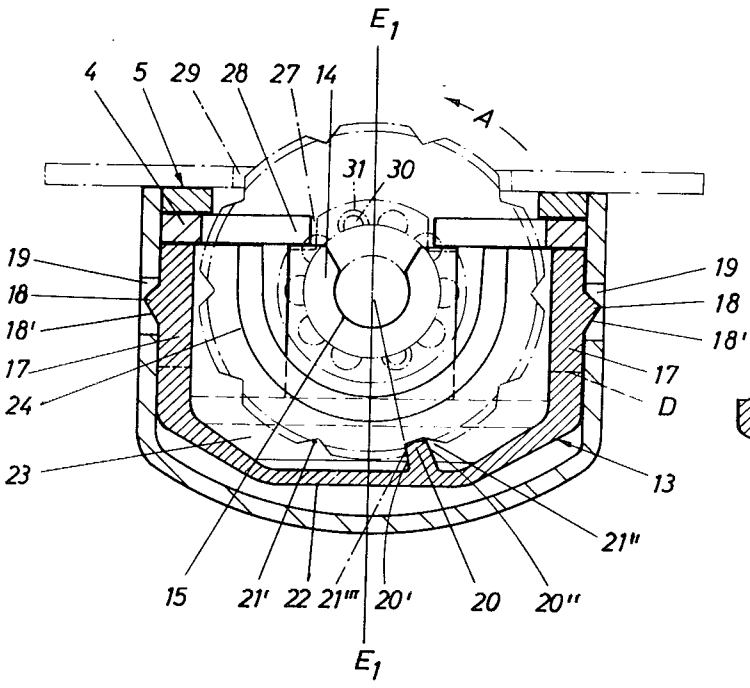

FIG. 4 corresponds to FIG. 3 but shows a modified hand actuator for displacement of the blocking sleeves;

FIG. 5 is a section taken on the line V—V in FIG. 4;

FIG. 6 is a cross-section through the FIG. 1 lock, illustrating the spring tongue in engagement with a number selection disc to block further turning in one direction; and, FIG. 7 corresponds to part of FIG. 6 but modified to show a righthand lock.

The combination lock shown consists of a combination lock part 1 and a counter-locking hasp part 2.

The lock part 1 is closed on the top by a lock front plate 3. A sliding locking bolt 4 is supported underneath it so to be able to slide longitudinally and carries at the hasp end a bolt nose 5 made in the form of a separate drag-bolt. The bolt nose 5 snaps on the latch side into an eye 6 of the counter-locking part 2. By the meeting of the hasp part with the latch bevel the bolt nose 5 gets pushed back against the action of a spring F in the direction of the arrow "x" without the sliding bolt 4 being correspondingly displaced with it. For this purpose the bolt nose is associated with the sliding bolt 4 so that it can shift longitudinally by a float "y" lying in the opening direction. From the end of the bolt nose 5 next to the latch, stop tabs 7 directed inwards to the housing are bent down for the spring F. These stop tabs extend on both sides of a spindle 8 of the lock. The bolt nose continues at the end remote from the latch into a drag hook 10 which engages behind a web 9 on the sliding bolt 4.

The spring F, formed from a double layer steel plate, is seated in a retention slit 11 in the bottom of a lock housing box-like insert 13 in the lock housing 12. The insert consists of elastic material such as a plastics material and is formed as an injection molded part which nests into the lock housing in such a way that both the housing and insert openings point in the direction of the lock front plate 3. The lock housing insert is designed completely symmetrically with respect to its transverse central plane E—E in such a way that the regions of the bottom 13' of the insert next to the end walls, in addition to the retention slits 11 formed as continuous transverse slits for the optional insertion of the spring F, also exhibit further openings 36 for optional pushing through of hand actuators B for displacement of the blocking sleeves.

The insert 13 forms on both sides of the transverse central plane, end walls 14 of the same shape. Bearings 15 are molded onto these for snapping-in of the ends of the spindle 8. The spindle 8 is stepped at both ends 8'. The bearings 15 are part cylindrical with a wall extending around by more than 180 degrees, and with inwardly coverging lead-in bevels 16 so that the end of the spindle 8 can be snapped-in upon assembly with the lock housing insert 13.

Figure 2:
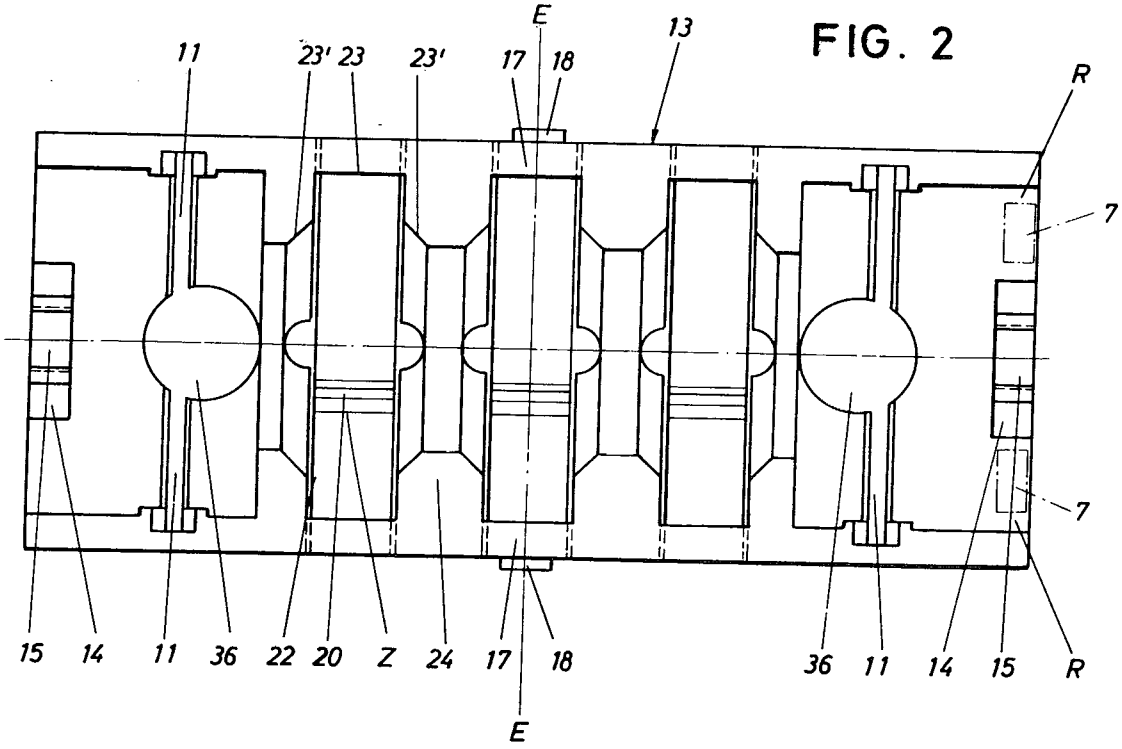
FIG. 2 is a plan of the lock housing insert.

Both end walls 14 of the insert are made wholly or partially free standing, so that at the sides there is space R for the bolt nose tabs 7 to be inserted (cf. FIG. 2).

For retaining the lock housing insert 13 in the lock housing 12 catch projections 18 directed outwards are molded onto the wide side walls 17. These enter window-like openings 19 in the lock housing 12 (cf. FIG. 6) and exhibit stop bevels 18'.

Moreover, spring tongues Z each forming a catch projection 20 are molded in one with the material of the lock housing insert. These catch projections cooperate with catch recesses 21', in the form of V-notches, distributed at equal angles round the periphery of each number selection disc 21. One catch recess 21'' on each disc 21 has a steeper flank 21''' directed towards the center of the spindle 8. The catch projection 20 forms two correspondingly aligned blocking flanks 20' and 20''. This design makes possible a datum position of the discs against further turning in the direction of the arrow A. In the basic blocking position shown in FIG. 6 the figure 0, for example, lies on the display line of the lock. The further figures follow in the direction of rotation in chronological sequence. This means that in the knowledge of this datum setting the user can by means of a so-called blind setting perform a resetting of the opening combination when the lock has been transferred into a corresponding position of readiness as is explained further below.

In order now to obtain the same direction of rotation (arrow A) with a righthand lock (FIG. 7), the lock housing insert simply needs to be turned round so that the catch projection 20, lying offset to the side outside the longitudinal central plane $E_1$—$E_1$ by half a catch projection, comes to lie on the other side of the plane. Correspondingly symmetrically designed discs are again blocked in the datum positions as may be seen from FIG. 7, because there the steeper flank 21''' of each disc 21 cooperates with the respective blocking flank 20'' now lying on the other side of the longitudinal central plane $E_1$—$E_1$.

For the achievement of the necessary ability to be resiliently overriden the spring tongues Z are seated on webs 22 which extend freely in the region of the bottom 13' of the lock housing insert and connect the wide side walls 17 together. The webs are made thinner than the thickness of the wide side walls 17 and, in the central section a, are about half as thick. This horizontal central section a continues on both sides in continuously thickening sections b rising gently upwards and running into the wide side walls 17 in a zone which lies above the tips of the catch projections 20. Transverse openings D between the webs extend a little higher up. Instead of continuous webs 22, if necessary freestanding spring strip tongues, i.e., starting out from only one of the wide side walls 17, may be used.

The bottom 13' of the lock housing insert 13 forms insertion wells 23 for the discs 21, leading to the webs 22 like a funnel. These wells facilitate the mounting of the inserted parts. The beveled flanks of the wells are designated by 23'. They start out from the bottom of the insert 13, which lies higher than the webs 22. The corresponding sections 13'' of the bottom from saddle-shaped crosswalls 24 which provide a stiff supporting skeleton for the insert 13 with the formation of guide and supporting webs reaching up to the top edge 13''' of the insert, for the nesting discs 21. The edge 13''' and some of the crosswalls 24 terminating at the same height form a sliding face for the sliding bolt 4, which does not need lubrication.

The number selection discs 21 are part of a secret opening combination arrangement which also includes blocking sleeves 26. These are arranged in a row on the spindle 8 and engage one another. The spindle, because of the stepped ends 8', and the fact that it abuts with its end faces the insert end walls 14, is secured rigidly in the lock housing.

Each blocking sleeve 26 is provided with two keyways 27. The latter cooperate with free standing keybolt like projecting tongues 28 formed from leg-like sections of the sliding bolt 4 which is frame-like.

For accessibility for actuation thereof the discs 21 pass through slots 29 in the lock front plate 3. For keying the blocking sleeves for rotation with their respective discs 21 they have, in known manner, engagement projections 30 which enter into recesses 31 of internal teeth in the discs 21. The sliding bolt 4 moreover leaves in the region of the discs 21 between the tongues 28 free spaces of such width that the rims 26' of the blocking sleeves 26 plus the discs 21 can project into it. The angular positions at any time are, as explained above, secured by the springy catch projections 20. When the number selection discs 21 are adjusted in such a way that the keyways 27 on the blocking sleeves 26 lie in alignment with the tongues 28, the sliding bolt can be displaced by means of the handle H in the direction of the arrow "x" in the unlocking direction against the force of the spring F which by one of its arms correspondingly loads the row of blocking sleeves. When, on the contrary, at least one of the blocking sleeves 26 has become turned by means of its disc 21 displacement of the sliding bolt is blocked.

For alteration of the opening combination, the blocking sleeves 26 are displaced against the force of the double acting spring F out of engagement with the discs 21 along the spindle against the direction of the arrow "x". For doing this the displacement hand actuator B shown in FIG. 1 or FIG. 5 is used. In both cases it extends directly behind the adjacent end blocking sleeve 26 and acts directly upon the rear end face 26'' of the sleeve. In the construction shown in FIGS. 1 and 3 the actuator B is designed in the form of a cam 32 supported to rotate about an axis perpendicular to the spindle 8. This cam has at least two contact faces 33 and 34 corresponding with the two basic positions of the actuator B and lying at an angle to one another. These faces are at a different distance from the axis of the shank 32' of the handle, so that by turning the cam end by the change of the contact faces 33, 34 the required displacement stroke ST is brought about. Thereby the blocking sleeves are shifted far enough towards the hasp for disengagement of the projections 30 from the recesses 31.

The displacement actuator B is retained on the inside of the insert by means of the snap-in association of the spindle. Its shank 32', depending upon the orientation of the insert 13, passes through either one or other opening 36. The lock housing exhibits congruent with the opening 36 at the end remote from the hasp likewise an opening 35. The back face of the cam 32 ends directly in front of the snapped-in spindle 8 so that the displacement actuator B which is bearing on the other side against the bottom 13' of the insert is secured axially.

The shank 32' passes through a section 12' of the lock housing 12 which is at an angle because of a bulge in the bottom of the housing. A section of the edge of the hole is thereby displaced relatively far into the region of the head of the shank, whereby, taking into consideration the spring loading acting on the cam, a favorable final bearing lying at about half the length of the shank is achieved. The corresponding bearing zone is designated by 38.

In the construction shown in FIGS. 4 and 5 the displacement actuator B is formed by a bush 39 arranged to be able to slide longitudinally on the spindle 8. This continues at its side next to the bottom of the housing into a sliding lever 40. The latter passes through one of the openings 36' provided in the regions next to the end walls in the bottom 13' of the insert 13 and further through an opening 35' in the lock housing 12. This displacement actuator B can be located in both end positions of the stroke ST. This location is achieved by spring claws 43 molded in the regions of the bottom of the insert next to the end walls. These may be molded in one with the material of the lock housing insert 13 in the form of free-standing partial areas of the bottom 13' of the insert. The spring claws 43 engage by their tips 44 behind locking edges 45 lying on the side of the sliding lever 40.

The sliding displacement of the blocking sleeves 26 by means of the displacement actuator B is done against the force of the spring F. By this displacement of the blocking sleeves 26 the engagement projections 30 get pushed out of the recesses 31 associated with them in the discs 21 which cannot themselves be displaced axially. A new secret combination can now be chosen by turning the discs by the desired number of clicks. After carrying out the resetting the cam 32 is turned out of the position illustrated in dash-dot lines into the position shown in solid lines, whereupon the locking collars return under spring action into the locking engagement position. The spring F itself secures the basic position of the actuator.

In the construction shown in FIGS. 4 and 5 the locking engagement is effected by change of location out of the position shown in dash-dot line into the end position shown in solid line in which the sliding lever 40 bears flat against the corresponding end wall 14 of the insert 13.

The spring F crossing the opening 36' is flush with the tips of the spring claws 43 so that in practice these form supporting zones which complete the cross slit 11 (cf. FIG. 4).

What is claimed is:

1. A combination lock for baggage, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, are in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions, characterized in that the spring tongues are formed integrally with a box-like insert in the lock housing, characterized in that the lock housing insert is formed symmetrically on each side of its transverse central plane, both end walls of the insert having similar bearings for receiving the ends of the spindle with a snap action and both regions of a bottom of the insert adjacent to the end walls having openings for the optional passage of a hand actuator for the displacement of the block sleeves relatively to the number selection discs.

2. A combination lock for baggage, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, are in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions, characterized in that the spring tongues are formed integrally with a box-like insert in the lock housing, characterized in that regions of a bottom of the lock housing insert adjacent to both end walls thereof having mountings for the optional location of springs which load the locking bolt and the blocking sleeves.

3. A combination lock for baggage, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, are in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions, characterized in that the spring tongues are formed integrally with a box-like insert in the lock housing, characterized in that spring claws are molded onto regions of a bottom of the insert adjacent to end walls thereof for location in two end positions of a hand actuator for the displacement of the blocking sleeves.

4. A combination lock for baggage, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, are in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions, characterized in that the spring tongues are formed integrally with a box-like insert in the lock housing, characterized in that the blocking sleeves are axially displaceable along the spindle which is axially fixed in the lock housing and the blocking sleeves are axially displaceable for uncoupling from the number selection discs by a hand actuator which acts on an end one of the blocking sleeves, and further characterized in that the hand actuator comprises a rotatable fingerpiece with a cam which acts on the end one of the blocking sleeves, the cam having at least two contact faces at different distances from the axis of rotation for alternately engaging the end one of the blocking sleeves depending on to which of two positions the fingerpiece has been rotated.

5. A combination lock according to claim 4, characterized in that a shank of the fingerpiece intersects an inclined portion of the lock housing.

6. A combination lock for baggage, the lock having a housing containing a spindle which carries individual rotatable blocking sleeves, the sleeves being capable of being uncoupled against spring action by hand-actuated axial displacement from respective number selection discs for resetting the opening combination and having keyways which, when the opening combination is set, are in alignment with, and can receive projections on, a longitudinally slidable locking bolt positioned behind a front plate of the lock; and spring tongues bearing against the peripheries of the number selection discs and arranged to engage in catch recesses in the peripheries to locate the number selection discs in angular positions corresponding to selected numbers and to limit the rotation of the number selection discs in one direction in datum positions, characterized in that the spring tongues are formed integrally with a box-like insert in the lock housing, characterized in that the lock housing insert is retained in the lock housing by means of catch projections which extend outwards from the side walls of the insert into openings in the lock housing.

* * * * *